United States Patent [19]

White

[11] 4,046,990

[45] Sept. 6, 1977

[54] TEMPERATURE SENSING AND CONTROL OF A FUSING ROLL

[75] Inventor: William E. White, Hilton, N.Y.

[73] Assignee: Eastman Kodak Company, Rochester, N.Y.

[21] Appl. No.: 565,993

[22] Filed: Apr. 7, 1975

[51] Int. Cl.[2] ..... H05B 1/02

[52] U.S. Cl. ..... 219/471; 73/351; 219/505; 219/530; 432/60

[58] Field of Search ..... 219/216, 469, 470, 471, 219/494, 501, 505, 530; 73/351; 432/60

[56] References Cited

U.S. PATENT DOCUMENTS

| | | | |
|---|---|---|---|
| 2,870,312 | 1/1959 | Westervelt | 219/471 |
| 3,189,729 | 6/1965 | Lusebrink | 219/469 |
| 3,398,259 | 8/1968 | Tregay et al. | 219/216 |
| 3,553,431 | 1/1971 | Petersen | 219/505 |
| 3,612,830 | 10/1971 | Dienes | 219/471 |
| 3,666,922 | 5/1972 | Leitner et al. | 219/469 |
| 3,690,176 | 9/1972 | Connolly et al. | 73/351 |
| 3,735,092 | 5/1973 | Traister | 219/501 |
| 3,745,304 | 7/1973 | Hutner | 219/216 |
| 3,825,725 | 7/1974 | Leitner et al. | 219/530 |

FOREIGN PATENT DOCUMENTS

| | | | |
|---|---|---|---|
| 874,012 | 6/1971 | Canada | 219/471 |

*Primary Examiner*—Volodymyr Y. Mayewsky
*Attorney, Agent, or Firm*—Milton S. Sales

[57] ABSTRACT

Apparatus for controlling the surface temperature of a fusing roller of the type having a heat-insulative, release surface over a thermally conductive core, by (1) internally heating the core, (2) sensing the temperature of the core rather than of the external release surface, (3) providing different temperature control settings for the core sensor and (4) selectively switching the internal heating means into operative relation with a predetermined control setting in anticipation of changes in heat loss from the external surface. The core of the fusing roll is thereby controlled toward the different temperature control settings, one at the "copy run" condition, another at the "idle" condition, and in some instances the same control setting is used for the "copy run" and the "idle" condition. Such core temperature settings are selected to create the particular temperature differentials across the heat-insulative roll cover that are necessary to counteract the different heat losses which occur during running and idling conditions in order to maintain the proper external release surface fusing temperature.

5 Claims, 3 Drawing Figures

TEMPERATURE SENSING AND CONTROL OF A FUSING ROLL

FIELD OF INVENTION

The invention relates to improved roller fusing apparatus for electrographic devices and more specifically to improved apparatus for controlling the temperature of the fusing surface of such apparatus.

DESCRIPTION OF PRIOR ART

It is well known in the art of electrographic roller fusing that the exterior surface temperature of fusing rollers must be maintained at a temperature which is high enough that proper fusing will result and offsetting will be eliminated, but not so high as to char the support material passing through the rollers, injure the roll coating, add excessive curl to the support material or cause the support material to stick to the rolls. Proper temperature control for the fusing surface has therefore presented a problem to all roller fusing devices.

The various prior art devices have attempted to control the temperature of the roller fusing surface by using thermocouples, thermistors and the like to sense directly the temperature of the exterior surface itself. In response to sensing of a temperature outside the desired fusing temperature range, the fuser heating source is appropriately controlled to return the fusing surface to the proper temperature.

Several problems have resulted from use of such surface sensing apparatus, including for example, damage to the fusing surface by the sensor, and destruction of the temperature sensor itself since the sensor is usually placed in close proximity to the path of the paper. Economically, sensors that detect surface temperature without damaging the fusing surface and yet are accurate and dependable are in many cases more expensive to manufacture and mount, than the type of sensor which could be used to sense the core of the roll.

One particularly desirable type of fusing roller employs a fusing surface of offset preventing material such as Teflon or silicone rubber. However, these offset preventing, i.e., "release", materials have a very poor heat conductivity and because of such, substantial differences in temperature between the parts of the fusing surface that do and do not contact the support medium result. Therefore it is usually necessary to sense an area of the roll surface that will contact the surface of the support medium; and this necessity amplifies the problems mentioned above and increases the possibility of paper jams and the difficulty of clearing such jams.

Some prior art devices have attemped to avoid or minimize the above-mentioned problems by sensing a thin layer of air very close to, but not touching, the exterior surface of the fusing roll. However, such devices become even more complicated and expensive.

In addition to the foregoing problems involved with surface sensors, there exists an inherent problem with respect to the overall accuracy of the control by such devices. Specifically, when the fusing surface sensed is not a good heat conductor and the sensor detects the temperature of only a discrete area of that surface, the surface sensing control devices can be "fooled" if localized hot or cold spots develop in the discrete area being sensed.

It is of course essential for proper fusing that the roll's surface be in the proper temperature range from the time the first copy sheet is contacted until the last copy sheet makes contact with the roll's surface. Therefore an additional problem has existed with respect to the heated fusing rollers in assuring that, during the period between a low (or high) temperature sensing and the time when response by the heating source has effected a return to the proper temperature, the fusing surface temperature does not move outside, i.e., undershoot (or overshoot) the proper range for acceptable fusing.

Some prior art devices hve attempted to alleviate the problem of undershoot by anticipating an increase in heat loss by the fusing surface snd pre-compensating or compensating for the anticipated or actual heat loss respectively. One prior art technique for compensating for an actual increase in heat loss utilizes a very precise sensing of the slight temperature drop occurring the moment which the support surface makes contact with the roll surface. This technique has utility when the heat is applied directly to the fusing surface, from the exterior of the roller; however, the sensor must be quite precise. Another technique provides an earlier anticipation of heat loss by detection of a copy sheet moving toward a radiant heat type of fusing oven. This technique provides for advance energization of the fusing oven during the time in which it takes the paper to move to the fusing over. However, more advanced energization would be desirable, particularly with respect to internally heated fusing rollers, to avoid unacceptable undershoot of the temperature of the fusing roller's outer surface

SUMMARY OF INVENTION

In view of the problems outlined above it is apparent that there is need in the art for improved apparatus for sensing and controlling the temperaturwe of the fusing surface of heated fusing rollers and for a more effective method of anticipating and compensating for a change in the heat loss from the fusing surface.

It is therefore an object of this invention to provide for such fusing apparatus, a simple and inexpensive means for sensing and controlling the fusing surface temperature.

It is another object of the present invention to provide for such fusing apparatus an improved means for anticipating a change in the heat load so as to eliminate undershoot and/or overshoot of the acceptable fusing surface temperature range.

In accordance with a preferred embodiment of the present invention, these objects along with certain other advantages of the invention are accomplished in conjunction with a fusing roller of the type having a thermally conductive core covered by an outer layer of offset preventing material by (1) internally heating the roller, (2) sensing the temperature of the internally heated conductive core rather than sensing the fusing surface temperature, (3) providing temperature control settings for the core sensor and (4) selectively switching the internal heating means into operative relation with a predetermined temperature control setting as soon as available knowledge in the apparatus indicates an increased or decreased heat loss will be forthcoming. The temperature control settings for the core sensor are selected by determination of the particular temperature differential which should exist across the cross section of a particular fusing roll to provide sufficient heat flow to compensate for the heat loss occurring at the outer surface under its various operating conditions in order to maintain a proper external release surface fusing temperature.

More specifically, in the art of heat transfer it is well known that the rate of heat flow through a material is directly proportional to the thermal conductivity of the material and the temperature differential across, i.e. the thermal gradient through, the material. Therefore it can be seen that if the fusing surface of such a roller is in equilibrium at a particular fusing temperature in the idle condition, a given temperature differential exists between the interior and exterior of the fusing roller and causes the predetermined rate of heat flow which compensates for idling heat losses e.g., to the surrounding air. Even though the idling heat losses are low, a significant temperature differential must exist particularly when the fusing roller involved includes an outer layer of release material that has a very low thermal conductivity.

Since the heat loss from the fusing surface during contact with a copy sheet and back-up roller greatly exceeds the ambient heat losses to air, it follows that during the copy operation, the compensating heat flow must be equally increased to maintain the fusing surface at the proper fusing temperature. Accordingly the temperature differential between the inner and outer surface must be significantly increased. Since the overall idling and copy run condition heat losses are generally constant for a given machine, the temperature differentials to maintain a particular fusing surface temperature in that machine can be determined for each condition.

The present invention makes use of the foregoing observations to avoid the problems presented by prior art surface sensing techniques and provides a simple and inexpensive core sensor together with either an "on-off" or a proportional controller to control the necessary temperature differential for a machine's idling, copy run or other operative conditions.

Since the present invention involves internal heating of the fusing roller there is a greater need to anticipate heat loss changes than there would be if external heating were used, to avoid temperature undershoot during the time lag while the change in heat flow effects the desired change in fusing surface temperature. If only one heat differential is utilized for copy run conditions, i.e., the optimum one for steady state copy run conditions, the need for a more advanced anticipation of heat losses increases. The invention therefore provides for a change from the idling temperature setting to the copy run setting immediately on receipt of any signal, such as a print command, which indicates copies will be forthcoming. This method of anticipation is workable whether an "on-off" or proportional controller is used because having switched to a different control point the sensor-controller will be substantially away from the "set point", causing immediate energization of the heating element. This reduces the time lag which is responsible for the undershoot and hence reduces the amplitude and duration of the undershoot.

It will be appreciated from the following detailed description that the invention disclosed herein provides an efficient, practical and quite inexpensive apparatus for controlling the surface temperature of a fusing roll such that proper fusing will result. Further, this invention provides for a most efficient apparatus for handling an increase or decrease in the heat loss from the roll surface by anticipating such variations in heat loss as soon as such knowledge is available in the apparatus.

BRIEF DESCRIPTION OF DRAWINGS

The objects, advantages and characteristic features of the subject invention will be in part apparent from the accompanying drawings, and in part pointed out in the following detailed description of the invention in which reference will be made to the accompanying drawings wherein like reference numerals designate corresponding parts, and wherein:

FIG. 2 is a partially schematic view of a circuit employed to control the temperature of the fusing roll at some predetermined temperature.

DETAILED DESCRIPTION OF PREFERRED EMBODIMENTS

Figure 1:
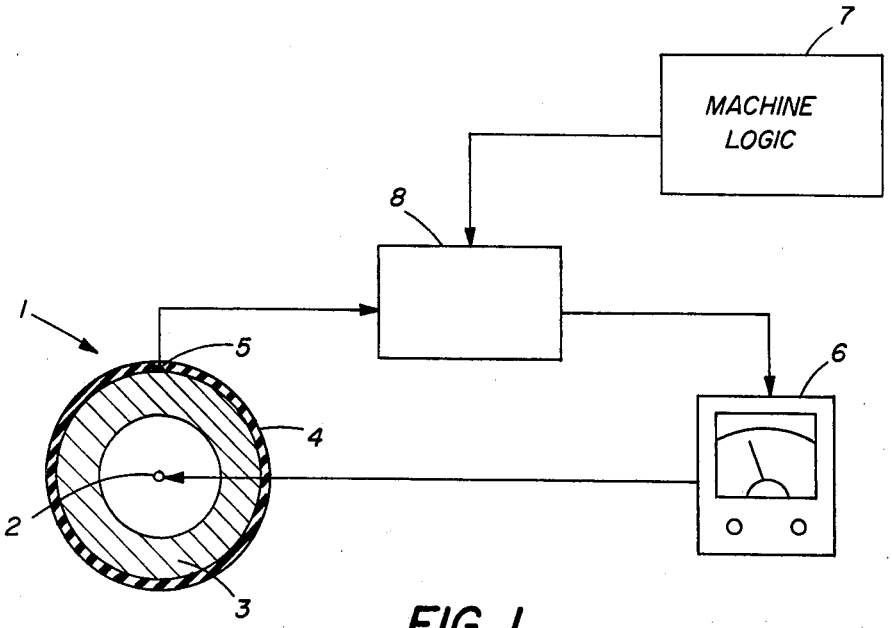

FIG. 1 illustrates an end view of an internally heated fusing roll 1 of a type with which the temperature control apparatus and method of the present invention are useful. The core 3 of fusing roll 1 consists of a good thermal conductor, e.g. metal, and is covered with an insulating layer 4 which is comprised of an offset preventing material of very low thermal conductivity, e.g. silicone rubber. A heater 2 including a conventional electrical heating element(s) is axially mounted within fusing roll 1 and a temperature sensor 5 is located in direct contact with the end of core 3. However, since core 3 is a good thermal conductor, the core temperature is relatively uniform all along the core so that the sensor 5 can be located at any convenient point contacting core 3. A temperature indicating controller 6 (described subsequently with respect to FIG. 2) is operatively connected to heater 2 and to a selectively insertable resistor 8 (described subsequently with respect to FIG. 2) which is operatively connected to temperature sensor 5 and, as schematically indicated, receives certain information, e.g., the warm-up initiation, copy start and/or copy stop control, from the control logic 7 of the machine in which the fuser is incorporated.

In operation, after a long period of non-use, such as overnight, the roller 1 must be warmed-up to a ready state capable of fusing toner on electrographic copies. In this ready, or idling state, the fusing roll may or may not be separated from its cooperating pressure roll (not shown) but no copy sheets are passing through the rolls. In response to a warm-up signal from the machine logic 7, selectively insertable resistor 8 is not added into the control circuit and controller 6 controls at a predetermined control setting for the idling state. The controller 6 then controls the energization of heater 2 to raise the temperature of core 3 to the proper "idling temperature" which will cause surface 4 to be at a proper fusing temperature in idling conditions.

Once core 3 has reached the predetermined temperature point for the idling state, controller 6 will terminate (or decrease) the energization of heating element 2 and roll 1 is ready to fuse copies. Should the temperature of core 23 drop below the idling temperature during this idling state, controller 6 will re-initiate (or increase) the energization of heater 2. The drop in core temperature is sensed before any substantial drop in the temperature occurs at surface 4.

When a copy cycle is initiated in the electrographic apparatus, its machine logic 7 provides a copy signal which causes selectively insertable resistor 8 to be added into the control circuit. With the addition of the resistor, controller 6 controls at a predetermined, higher control setting appropriate for the run state, in which copies are passing through roll 1 and pressure roll. Once controller 6 is controlling at this higher control setting it will actuate heater 2 until core 3 reaches the predetermined temperature appropriate for fusing in the run state. Core 3 will be at a much higher temperature than in the idling state because it must be able to compensate for the heat loss to the copy sheets, in addition to that lost to the surrounding environment.

For example, when using a silicone elastomer surface of about 50 mils thickness having a durometer of approximately 70 and forces of approximately 15 pounds per linear inch forcing the fusing and pressure rolls together, 8½ × 11 inch sheets of 20 pound bond paper moving at speeds of 10 to 20 inches per second may require thermal differentials between the core temperature and the outer surface temperature of about 10° to 40° F to maintain the outer surface at a proper fusing temperature.

When the copy run has ended and sheets are no longer making contact with the roll's surface, the machine logic 7 provides a signal which causes selectively insertable resistor 8 to be removed from the control circuit, thereby causing controller 6 to control at the lower temperature setting applicable for the idle state. The controller will thereupon de-energize heater 2. In order to reduce the amplitude and duration of the overshoot in the surface 4 temperature after a run state is completed, the machine logic can be designed to cooperate with copy counters of the apparatus to cause the controller to control at the idle state temperature for core 3 just prior to the end of the copy run. The value of this technique must be evaluated by weighing its benefits against its cost. Whether or not this additional logic is employed, controller 6 will react to the excessive temperature of core 3 and will de-energize heater 2.

It is important to note that there are situations where the fusing roller may not go through the full cycle from the idle to the run condition. Such a situation may be with a "short copy run" where the apparatus is not in the run state long enough for the core to heat up to the predetermined temperature for that condition. Despite the fact that the core may not reach this temperature, proper fusing will result because there is a temperature range over which proper fusing is possible and in short runs the heat load from the copy sheets will not have lowered the outer surface temperature below the lower limit of this range. There are also situations where the rolls (fusing and pressure rolls) will be at some transient conditions between the two steady state conditions when a new "copy run" is initiated. In such situations proper fusing will result and if the apparatus is in operation for a long enough period the roll's core will reach the predetermined temperature point for the run state.

Figure 2:
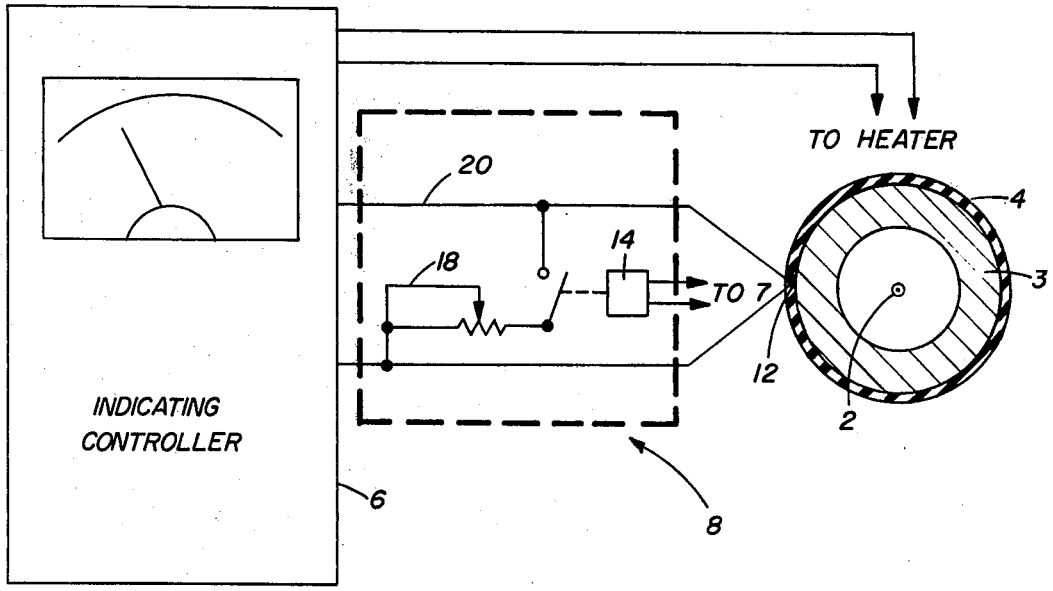
FIG. 2 is a partially schematic view of the fusing device incorporating one embodiment of the present invention.

FIG. 2 illustrates one embodiment of an apparatus useful in the practice of the present invention and in which the temperature sensor is a standard thermocouple 12 of the type consisting of two dissimilar metals. Lead wires 20 connect thermocouple 12 to a commercially available controller 6 such as for example a Model No. 711 Indicating Controller marketed by Assembly Products Inc. The controller 6 operates in a well-known manner to energize or de-energize heater 2 in an "on-off" mode according to the voltage received from thermocouple 12 and thereby closely controls the temperature of the core.

In operation, a potentiometer dial on the controller is adjusted with solenoid switch 14 open so that a predetermined voltage, i.e. a voltage just above the level at which the heater switch is actuated to the on condition, exists across the controller terminals when the thermocouple is in the presence of the proper core temperature for idling condition of the fuser. With this calibration the "on-off" controller will energize heater 2 when the voltage from the thermocouple is below that representative of the proper idling temperature of core 3 and de-energize heater 2 when the voltage level is at or above the voltage level representative of the proper idling temperature for core 3. In response to a signal from machine logic 7, indicating the start of a copy cycle, solenoid switch 14 is energized to add variable resistor 18 in the circuit and thereby shunt thermocouple 12. The addition of variable resistor 18 in the circuit decreases the voltage across the controller terminals; and in response to the drop in voltage the "off-on" controller energizes heater 2 to raise the temperature of core 3.

Variable resistor 18 is adjusted to create a voltage across controller 6 that will appropriately energize and de-energize the heater when the core temperature reaches or falls below the higher temperature level required for maintaining proper fusing temperature in the copying mode. Thus, when the heater has raised the core temperature to the proper level for copy load, the voltage across controller 6 will signal de-energization of the heater which will continue until the core temperature drops below the proper level for fusing.

In response to a signal from machine logic 7 that the copy cycle is at or near the end, solenoid switch 14 is de-energized and resistor 18 is removed from the circuit causing a voltage rise across, and hence an overheat indication to controller 6. In response to this overheat indication, heater 2 is de-energized until core 3 cools back down to the idling temperature.

Figure 3:
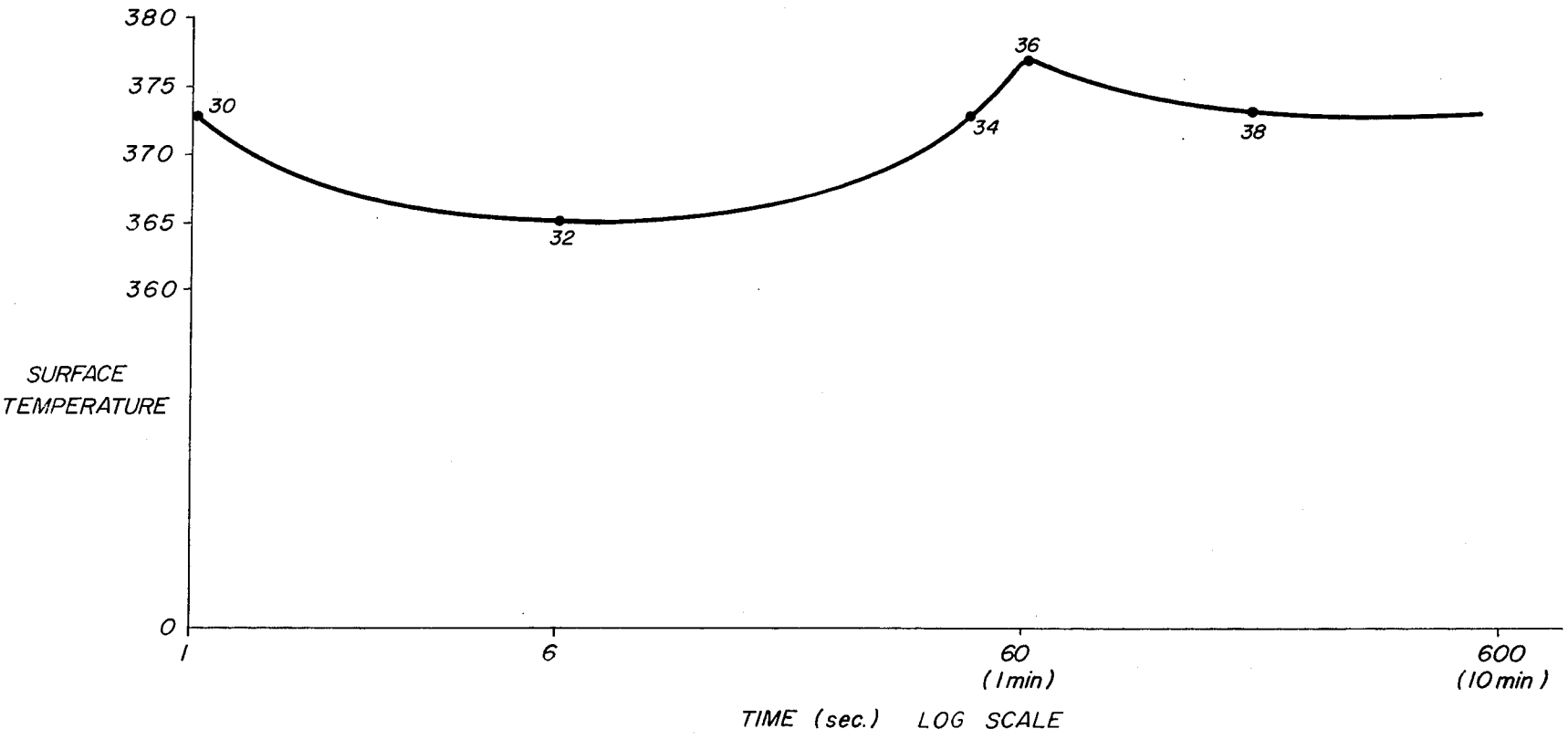
FIG. 3 is a graph drawn to log scale showing the excellent control of the fusing roll's rubber surface temperature during a typical copy cycle.

FIG. 3 illustrates the results of a time (*t*) vs. surface temperature (T) test, plotted on log scale, which was run during a typical copy cycle to demonstrate the efficiency of the temperature control apparatus, described with respect to FIGS. 1 and 2. The test was run using an aluminum fusing roll having a 0.500 inch wall thickness, covered with 0.050 inch thick Emerson-Cuming silicone rubber (EC-4952); a chrome plated, steel pressure roll having a core diameter of 1.990 inches covered with a 0.0020 inch thick heat shrinkable F.E.P. sleeve giving an outer core diameter of 2.030 inches; a G.E. heater (WH1600T3-240V) axially mounted within the fusing roll and having a maximum wattage of 1600 watts; and Iron-Constantan (Type-J) core sensor resting against the end of the core as shown in FIG. 1; and an "on-off" Assembly Product Industries M-711 controller.

An Iron-Constantan surface sensor (Type-J) resting on the rubber surface of the fusing roller, 90° ahead of the nip formed by the fusing and pressure rollers and placed about half way along the roller, was connected to an Omega Engineering Industries Thermocouple temperature indicator (Model DS-500) and used to measure the fusing surface temperature for purposes of this demonstration. International Xerographic Bond paper (8½ × 14 inches, 20 pound) was passed between the rollers which were under pressure of about 217.5 pounds causing a nip of about 0.150 inch width. The paper was fed between fusing roll 1 and a cooperating pressure roll at approximately 10 inches per second with approximately ½ inch spacing between copies.

The core temperature set points, i.e. the core temperatures below which the heater was energized were 381° F for the idle mode and 411° F for the copy mode with the objective of maintaining a surface temperature of approximately 375° F in both the idle and copy modes. Since the core temperature was taken at the end of the core and the surface temperature was taken midway along the length of the fusing roll 1, the differences in the core and surface temperatures for each state do not necessarily represent the temperature differentials, i.e., thermal gradients, across the outer rubber layer.

Referring to FIG. 3., point 30 indicates the surface temperature after the control apparatus has caused heating of the fusing roller to a steady condition for the idle mode, core 3 being maintained at about 381° F producing a surface 4 temperature of almost 375° F. The fusing roll idled at point 30 for 10 minutes before any paper was delivered to the roll. Using an "off-on" controller the "off" power of heater 2 in effect during the idle state was 100 watts. A minimum amount of power is applied to heater 2 during the "off" condition to reduce thermal shock to heater 2. This minimum power must be lower than that required to maintain core 3 at the appropriate temperature for the idling mode so that the controller can function in the idle modes.

In response to a copy signal from machine logic 7 solenoid 14 was then energized to engage variable resistor 18 across control circuit 10 to shunt thermocouple 12 resulting in a decreased voltage across the controller terminals. Heater 2 was then energized to raise the core 3 temperature to 411° F. In FIG. 3, it can be seen that while core 3 temperature is being raised, surface 4 temporarily drops to a lower temperature at point 32 (about 6 seconds) because the initial heat loss to copies is not being replaced fast enough. The plot is shown on log scale so that this initial temperature drop can be essentially magnified in time. At point 34 core 3 has been heated to 411° F and surface 4 is again at a proper fusing temperature of about 375° F.

As the core temperature is rising to get the surface temperature up to about 375° F the core sensor is constantly calling for heat resulting in a slight overshoot at point 36 of about 4 to 5°, the amount and duration of such overshoot depending on the constants of the system such as mass, thermal conductivities of materials used, heater capacity, and response of the controller and sensor. Once the core sensor signals the controller that the core is up to about 411° F, the controller will stop applying heat and the surface will level of at point 38 where it will remain for the duration of the copy cycle.

It will be understood that numerous alternative circuits can be provided to control the heater in connection with two desired temperature levels for the roller core. Thermistors could be utilized in conjunction with a circuit of the type described or separate. Alternatively, independently operative temperature sensors and/or control circuits can be selectively rendered operative by appropriate machine control. If desired, the heater can alternatively be controlled to provide heat proportional to the differential between the actual voltage across the controller terminals and the desired voltage so as to further obviate overshoots.

Also the disclosed fusing apparatus can be utilized with only one control point, i.e., with the core maintained at a single temperature in both the idle and run modes. For example in medium or low volume machines the fusing temperature of the roller's external surface can be substantially lower than in higher volume machines since in the medium or low volume machines the material to be fused is in the roll nip longer, at the lower speed. In such applications, the rise in fusing surface temperature, occurring during an idle condition with the same core temperature as in the run mode, does not result in the objectionably high temperature that would occur in higher volume machines which must operate at higher fusing surface temperatures. A single core set point is thus acceptable in the lower speed machines while maintaining the benefits of core sensing.

While the invention has been shown and described in conjunction with a fusing roller having an aluminum core covered by silicone rubber, other combinations of thermally conductive cores and offset preventing surface coatings can be utilized with advantage in practice of the present invention. The temperature sensor is herein disclosed as located at the end of the fusing roll's core, but it may be located at any point on the core because the thermally conductive cores allow heat to flow readily along the core from middle to end and around the core peripherally resulting in an almost uniform temperature at every point along the core. Also, other means of contact or non-contact temperature sensing of the core, such as use of infrared sensors, expansion and contraction of the metal core, sensing a sample of air or liquid near the core, etc., may be used.

The invention has been described in detail with particular reference to certain embodiments thereof, but it will be understood that variations and modifications can be effected within the spirit and scope of the invention.

I claim:

1. In an electrographic device having a fusing roller of the type including a heat conductive inner core and a heat insulative release coating which includes an outer fusing surface, improved apparatus for maintaining said fusing surface at a desired fusing temperature, said apparatus comprising:

a. means for supplying heat to said inner core;

b. means for sensing the temperature of said inner core;

c. first temperature control means actuatable for selectively interconnecting said sensing means and said heat supplying means to maintain said inner core at a first predetermined core temperature;

d. second temperature control means actuatable for selectively interconnecting said sensing means and said heat supplying means to maintain said inner core at a second predetermined core temperature; and e. means, operatively interconnecting said electrographic apparatus and said first and second temperature control means, for selectively actuating either of said first and second temperature control means in response to a signal from said electrographic apparatus.

2. The invention defined in claim 1 wherein said electrographic device includes means for providing copying and idling modes, wherein said first predetermined core temperature is above said desired fusing surface temperature an amount causing the heat flow from within said core to said fusing surface to be substantially equal to the heat loss from said fusing surface during said idling mode and wherein said second predetermined core temperature is above said desired fusing surface temperature an amount causing the heat flow from within said core to said fusing surface to be substantially equal to the heat loss from said fusing surface during said copying mode

3. The invention defined in claim 2 wherein said electrographic device includes means for signalling initiation and termination of said copying mode and said actuating means is responsive to said copy initiating signal to select said second predetermined core temperature and responsive to said copy terminating signal to select said first predetermined core temperature.

4. In electrographic apparatus of the type having a copying and non-copying mode, the improvement comprising:

a. means for emitting one signal indicative of the apparatus being in its copying mode and for emitting another signal indicative of the apparatus being in its non-copying mode;

b. roller fusing means including:

1. a roller core;

2. heating means for supplying heat to said roller core, said heating means having a first state to maintain said roller core at a first predetermined core temperature and a second state to maintain said roller core at a second predetermined core temperature greater than the first predetermined core temperature; and 3. control means, responsive to said signal emitting means for placing said heating means in its second state in response to said one signal and for placing said heating means in its first state in response to said other signal.

5. In an electrographic device including a fusing roller of the type including (1) a heat conductive inner core having a heat insulative outer release coating which includes an outer fusing surface, and (2) controllable heat source means for heating the inner core of the roller and thereby heating the outer fusing surface, improved apparatus for maintaining said fusing surface at a desired fusing temperature, said apparatus comprising:

a. means for directly sensing the temperature of said inner core; and b. temperature control means, responsive to said sensing means and associated with said heat source means to maintain said inner core at a predetermined core temperature above the desired temperature of said fusing surface to provide proper heat flow through said heat insulative outer release coating to compensate for heat loss occurring at the outer fusing surface, whereby said fusing surface is maintained at the desired temperature.

* * * * *

UNITED STATES PATENT AND TRADEMARK OFFICE

CERTIFICATE OF CORRECTION

PATENT NO. : 4,046,990

DATED : September 6, 1977

INVENTOR(S) : William E. White

It is certified that error appears in the above-identified patent and that said Letters Patent are hereby corrected as shown below:

Column 2, line 9, "hve" should read --have--; line 11, "snd" should read --and--; line 25, "over" should read --oven--; line 34, "temperaturwe" should read --temperature--.

Column 3, line 47, "The" should read --This--.

Column 4, line 10, "Fig. 2" should read --Fig. 1--.

Column 6, line 51, "0.0020" should read --0.020--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*